United States Patent [19]

Hickman et al.

[11] Patent Number: 4,726,578

[45] Date of Patent: Feb. 23, 1988

[54] PAPER-FOLDING APPARATUS

[75] Inventors: Robert G. Hickman, Reading; Keith Riches, Frimley, both of England

[73] Assignee: Bell & Howell Company, Chicago, Ill.

[21] Appl. No.: 885,113

[22] Filed: Jul. 14, 1986

[30] Foreign Application Priority Data

Jul. 12, 1985 [GB] United Kingdom ..... 8517700

[51] Int. Cl.[4] ..... B41L 43/08

[52] U.S. Cl. ..... 270/42; 226/195; 493/413; 493/446

[58] Field of Search ..... 270/32, 41–51, 270/57, 6–12, 15–18, 20.1, 21.1; 226/196, 195; 493/455, 456, 458, 439, 446, 413, 416, 417

[56] References Cited

U.S. PATENT DOCUMENTS

| | | | |
|---|---|---|---|
| 2,747,865 | 5/1956 | Marshall, Jr. | 270/32 |
| 3,652,357 | 3/1972 | Vogel et al. | 270/52 |
| 3,784,187 | 1/1974 | Takayanagi | 270/42 |
| 3,786,742 | 1/1974 | Hertrich | 493/446 X |
| 3,937,377 | 2/1976 | Schueler | 225/97 X |
| 3,991,992 | 11/1976 | Randall et al. | 270/52 |
| 4,050,361 | 9/1977 | Traise | 226/195 X |
| 4,189,134 | 2/1980 | Mills et al. | 270/15 |
| 4,490,132 | 12/1984 | Ogura et al. | 270/42 |
| 4,533,130 | 8/1985 | Suter | 493/446 |
| 4,611,799 | 9/1986 | Nuttin | 270/52.5 |

*Primary Examiner*—E. H. Eickholt

*Attorney, Agent, or Firm*—Griffin, Branigan, Butler

[57] ABSTRACT

Apparatus for forming a longitudinal fold in a web of paper includes a paper feed arrangement, paper folding means arranged below and downstream of the paper feed arrangement, and guide means extending between the paper feed arrangement and the paper folding means. The paper feed arrangement includes a support on which are mounted a pair of tractor drives engageable with the edges of the web. The support is movable in a transverse direction to alter the position of the web relative to the paper folding means.

22 Claims, 3 Drawing Figures

PAPER-FOLDING APPARATUS

TECHNICAL FIELD

The present invention relates to apparatus for folding paper, in particular, to apparatus which are used to form longitudinally-extending folds in continuous stationery of the kind frequently associated with computer printers.

BACKGROUND OF THE INVENTION

Existing machines, for example, those described in U.S. Pat. Nos. 4,478,223, 4,395,255 and 4,516,761, and United Kingdom Patent No. 1177241 include a first feed roller mounted above and extending at right angles to an output roller. The paper is folded along a preformed weakened fold line, which may be either pre-creased, scored or perforated, as it passes between the upper feed roller and the lower output roller. The machine may also include some form of guide arrangement, to assist in forming the fold, located between the upper and lower rollers.

These machines have a number of disadvantages. They will only operate satisfactorily if the paper used is provided with an already-weakened fold line. This in itself leads to difficulties in that the tension applied to the paper in drawing it through the machine may cause it to burst or tear, particularly where the fold line is perforated. Furthermore, such machines are, in general capable only of providing a central fold.

Also, because it is necessary with existing machines to pre-perforate or pre-score the paper web, it has not, in general, been possible to use such machines to fold multi-sheet stationery. In addition, such machines can only be used to form a right-hand or a left-hand fold. A change from one type of fold to the other requires substantial reconstruction of the machine.

In accordance with the first aspect of the invention, there is provided apparatus for forming a longitudinally-extending fold in a web of paper, the apparatus comprising:

a paper feed arrangement for driving the web through said apparatus, the said paper feed arrangement including a support extending transversely of the web and mounting a pair of drive members engageable with opposite longitudinal edges of the web; and paper folding means disposed below, and downstream of, said paper feed arrangement, the paper folding means including a pair of fold-plates defining a narrow gap through which the web passes to form a fold and a pair of output rollers resiliently biased into engagement with one another, between which the web passes on leaving said fold-plates, the gap defined by the fold plates and by the output rollers extending at right angles to the support;

said support carrying said drive members being movable in a transverse direction to alter the position of the web relative to the fold-plates and, hence, to alter the transverse position of the fold formed in the web.

In accordance with a further aspect of the invention there is provided apparatus for forming a longitudinally-extending fold in a web of paper, the apparatus comprising:

a paper feed arrangement for driving the web through said apparatus;

paper folding means disposed below, and downstream of, said paper feed arrangement, the paper folding means including a pair of fold-plates defining a narrow gap through which the web passes to form a fold and a pair of output rollers resiliently biased into engagement with one another, between which the web passes on leaving said fold-plates; and guide means extending between said paper feed arrangement and said paper folding means for guiding the web into the fold-plates, said guide means including a member defining a V-shape having edges extending from position spaced apart by a distance greater than the width of the web and immediately below the paper feed arrangement, to a vertex substantially immediately above the fold-plates and disposed centrally thereof.

In accordance with a still further aspect of the invention there is provided apparatus for forming a longitudinally-extending fold in a web of paper, the apparatus comprising:

a paper feed arrangement for driving the web through said apparatus, the said paper feed arrangement including a support extending transversely of the web and mounting a pair of tractor drives having rotary members which, in use, engage the margins of the web and which are rotatable to drive the web in a downstream direction;

paper folding means disposed below, and downstream of, said paper feed arrangement, the paper folding means including a pair of fold-plates defining a narrow gap through which the web passes to form a fold and a pair of output rollers resiliently biased into engagement with one another, between which the web passes on leaving said fold plates, the gap defined by the fold-plates and by the output rollers extending at right angles to the support; and first and second motors, coupled to said tractor drives and to said output rollers respectively, and control means coupled to said first and second motors and operable to actuate said motors to drive the tractor drives and output rollers simultaneously.

BRIEF DESCRIPTION OF THE INVENTION

We have found that such apparatus is capable of forming a stable fold in un-perforated and unscored paper webs. Consequently, it may be used to fold both single and multi-sheet webs. Furthermore, because the folded web exists from the apparatus between a pair of rollers, it can be led away equally easily to either side to produce a right-hand or a left-hand fold as required. When fitted with guide means, the apparatus may also be used to form a fold in a range of transverse positions across the web.

When the machine is first started up, the web is led by hand through the paper feed arrangement, over the guide means, to the fold plates and the rollers. The position of the fold is judged roughly by eye and the folded leading edge of the web inserted between the fold plates and the output rollers. The drive elements are then adjusted on their support until they properly engage the edges of the web. The web is then advanced through the apparatus. During this movement, the output rollers act on the web so as to align its edges and form a parallel fold. The transverse position of the fold can then be adjusted finely by moving the support together with the drive elements and the web in a transverse direction relative to the paper folding means. Once the correct fold position is achieved, the apparatus will continue to form a straight, parallel, accurately-positioned fold. By appropriately adjusting the transverse position of the support, drive elements and web, the fold may be formed in any of a range of positions across the web.

BRIEF DESCRIPTION OF THE DRAWINGS

Apparatus in accordance with the invention will now be described in detail, by way of example only, with reference to the drawings, in which.

DETAILED DESCRIPTION OF A PREFERRED EMBODIMENT

Figure 1:
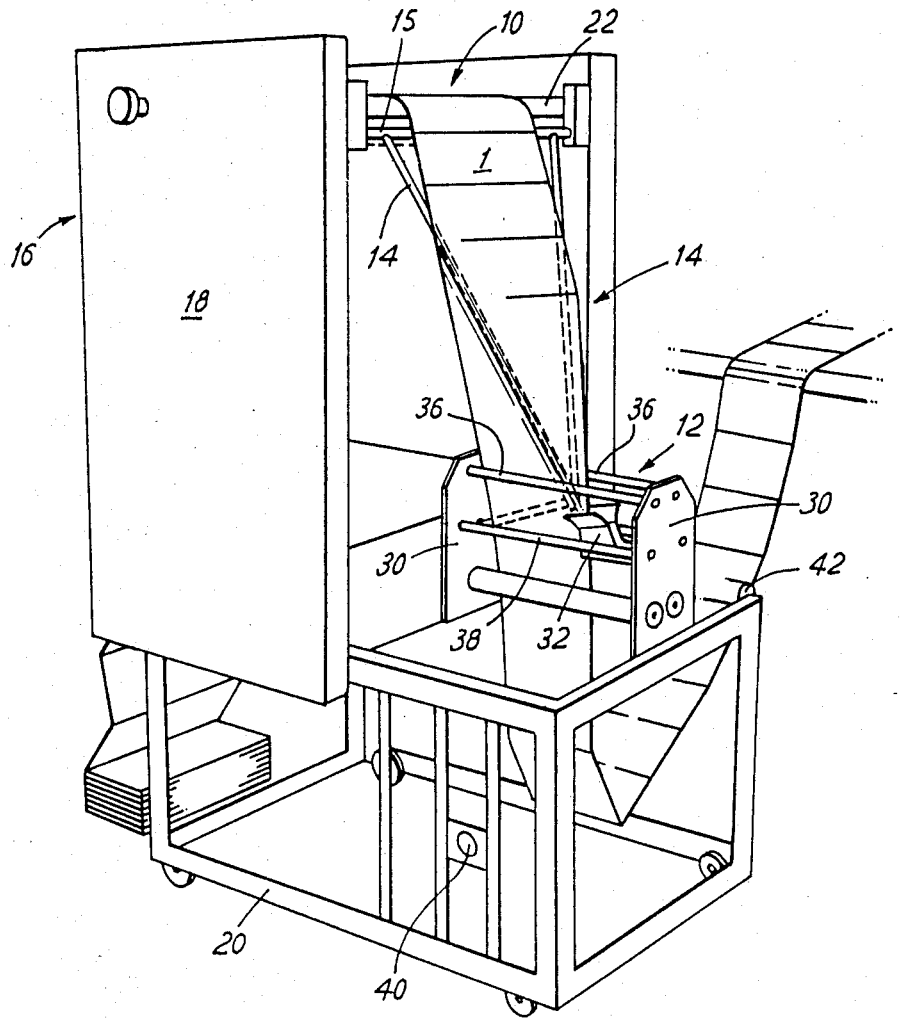
FIG. 1 is a perspective view of paper-folding apparatus in accordance with the invention.
Figure 2:
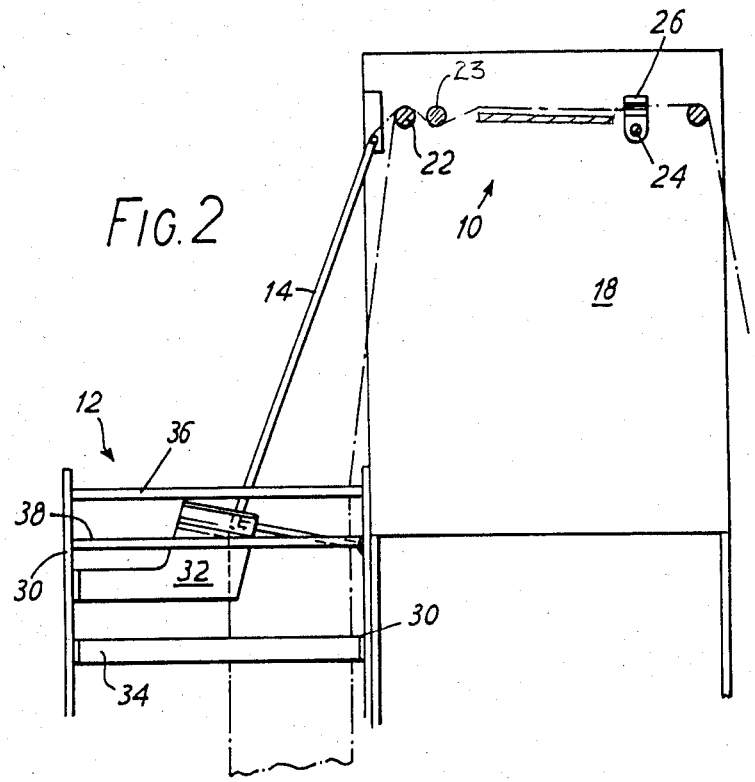
FIG. 2 is a fragmentary side view of the apparatus of FIG. 1.
Figure 3:
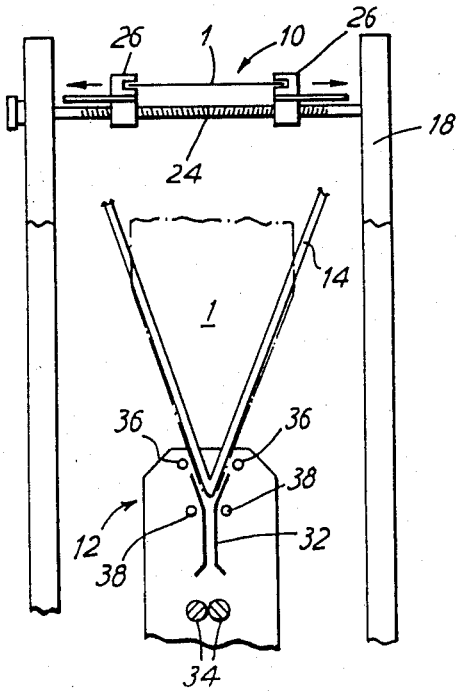
FIG. 3 is a fragmentary front view of part of the apparatus of FIG. 1.

The paper-folding apparatus shown in the drawings comprises a paper feed arrangement 10, paper-folding means 12 arranged downstream of the paper feed arrangement 10, and guide means 14 disposed between the feed arrangement 10 and the paper folding means 12. All of these are supported on a rigid, generally upright frame 16.

The frame 16 consists of a pair of substantially vertical side pillars 18 which are mounted at one end of a wheeled trolley 20. The frame 16 is provided with wheels to enable the machine to be moved easily from one location in a paper-processing installation to another. the trolley 20 is on the form of an open framework defining a cuboid shape with the side pillars 18 extending from opposite longitudinal edges at one of its ends.

The paper feed arrangement 10 is mounted at the uppermost ends of the side pillars 18 and includes an input roller 22 and a support 24 on which are mounted a pair of drive elements 26 for advancing the paper web 1 through the machine. Between the input roller 22 and support 24, and below them, is mounted a friction bar 23 whose purpose will be described in greater detail below.

The support 24 extends between the side pillars 18 and can slide in a lengthways direction relative to them. The support 24 carries the drive elements 26 which, in use, engage the edges of the web 1 and rotate to drive it in a downstream direction. The drive elements 26 may be of any convenient type, for example, pin-type tractor drives. The drive elements 26 are mounted on the support 24 so that they can be moed along its length but are provided with means, for example, set-screws or some convenient form of latching device, which allow their position along the support 24 to be fixed.

The input roller 22 is an idler roller mounted downstream of the support 24 and extending parallel to it.

Mounted on the upper edges of the trolley framework 20 but below the paper feed arrangement 10 are a pair of opposite support plates 30. Extending between the support plates 30 in a direction generally perpendicular to the input roller 22, are the various members which make up the paper-folding means 12. These consist primarily of a pair of opposed fold-plates 32 and, mounted directly beneath them a pair of sprung, driven output rollers 34.

The fold plates 32 are a pair of generally flat metal plates spaced from one another to define a narrow gap. The uppermost corners of the plates 32 at their edges remote from the fold are curved outwardly so that they converge their lower edges. In use, the upper edges of the plates 32 act to guide the web into the gap. As mentioned above, a pair of spring rollers 34 are mounted immediately below the fold-plates 32. The rollers 34 are resiliently-biased into engagement with one another but are provided with means (not shown), for example, a lever-operated cam, by which they may be moved apart, if desired.

Whilst the rollers 34 engage the entire width of the web 1, the fold-plates 32 only engage the region adjacent the fold. Consequently, there would be a tendency for rippling to occur in the web between the fold-plates 312 and the rollers 34 as the web 1 moves from a relatively wide V-shaped configuration at the fold-plates 32 to a very narrow V-shape (in fact, with the arms of the "V" almost parallel) just above the rollers 34. To avoid this, the paper folding means 12 is also provided with two pairs of opposite parallel guide rods 36 and 38 extending between the support plates 30.

The uppermost pair of guide rods 36 is mounted above the fold-plates 32 with the guide rods disposed symmetrically about the gap defined by the fold-plates 32, and a few centimeters apart. the lowermost pair of guide rods 38 is mounted at the level where the converging upper portions of the fold-plates 32 come together. The guide rods 38 are only a few millimetres apart.

As the web 1 is drawn through the paper folding means 12, the guide rods 36 and 38 and the convergent shape of the fold-plates 32 tend to bring together the free edges of the web 1 so that when the web reaches the rollers 34 its edges are only a few millimetres apart and rippling of the web 1 is avoided.

Between the paper feed arrangement 10 and the paper folding means 12 is arranged guide means 14 in the form of a V-shaped member. The V-shaped guide means 14 is formed of tubular metal so as to be rigid and extends at an angle form just beneath the input roller 22 to a vertex just above the fold plates 32. The guide means 14 is arranged centrally of both the input roller and the fold-plate 32. At its uppermost end, the arms of the V are secured to a cross-piece 15 which extends between the side pillows 18. The distance between the uppermost ends of the arms of the V-shaped guide is at least equal to and, in practice, greater than the width of the web 1. At its lower end, the guide 14 means is supported rigidly in position by means of a strut 17 which is fixed at one of its ends to the vertex of the guide member 14 and at its other end to one of the support plates 30.

The V-shaped guide means 14 is mounted so that it extends in a plane at an angle to the vertical. We have found that for optimum results, the angel the guide means 14 makes with the vertical is equal to half the angle made by the two arms of the guide means where they come together at its lowermost vertex. In order that the fold in the web 1 should be formed as smoothly as possible, the vertex angle of the V-shaped guide means 14 is as acute as space allows and, preferably, around 20°.

The web 1 is drawn through the apparatus by the combined actions of the drive elements 26 and of the output rollers 34. The drive elements 26 and rollers 34 are driven by two separate motors (not shown) which are operated by a single control means. The control means, which may be microprocessor, operates the two motors so that the drive elements 26 and rollers 34 are driven simultaneously to advance the web 1. The rollers 34 are driven at a slightly higher speed than that of the drive elements 26 but are provided with "magnetic slip" or some other clutch arrangement which permits the required adjustment in their speed. Consequently, when frictionally engaged by the web they tent to adopt the same speed as that imparted to the web 1 by the drive elements 26. Thus, the web 1 is kept under tension but is not subjected to excessive tension which might cause it to burst or tear.

The control means which operates the drive motors is responsive to the output of a photoelectric sensor 40 mounted on the trolley framework 20.

It is usual for the output of paper folding apparatus of this type to be fed directly into further web-processing equipment, for example, a guillotine. However, if the intake rate of the further equipment is less than the output rate of the paper folding apparatus, the paper web stockpiles between the two. To avoid this, the further equipment is fed from the folding apparatus on demand.

The folded web output from the folding apparatus is looped over a further output roller 42 mounted on an upper edge of the trolley framework 20. Where the intake rate of the further processing equipment is less than the output rate of the paper folding apparatus, the loop between the output rollers 34 and the further roller 42 will deepen until it is sensed by the photoelectric sensor 40. At this point, the sensor output signal will cause the drive motors to stop so that the web ceases to advance through the folding apparatus. As the further processing equipment continues to operate, the loop will gradually be taken up until it is no longer detected by the sensor 40. The sensor 40 then causes the control means to operate the motors to advance the web through the folding apparatus until the looped web 1 is once again detected by the sensor.

In use the web 1 is advanced by the drive elements 26 and the output rollers 34 over the input roller 22 from which it follows an inclined path over the V-shaped guide member 14. Below the guide member 14 the web enters between the fold-plates 32. As the web is advanced between the fold-plates 32, the tension in the web causes it to be pulled around the lower part of the guide member 14 so that its free edges begin to come together. The fold plates 32 form a "soft" fold in the web which then continues between the output rollers 34, which form a "hard" fold.

It will be appreciated that, in order to form a proper fold, the paper web 1 must be drawn through the paper-folding means 12 under tension. However, there is a risk that, if the tension is too great, the web 1 will be pulled off the tractor drives 26. To avoid this, the web 1 passes under the friction bar 23 which is mounted between, but below, the support 24 and the input roller 22. The frictional engagement of the web 1 with the bar 23 prevents the tension in the web 1 being transmitted back to the portion of the web 1 which is engaged by the tractor drives 26. The friction bar 23, thus, provides a form of "strain relief" to prevent the web 1 being pulled off the drive elements 26.

Because the folded web 1 exits from between a symmetrical pair of rollers 34, it can be led away equally easily to either side, thus allowing the apparatus to be used to produce either a right-hand or a left-hand fold.

When a "run" is first commenced, the front edge of the paper web is led through the apparatus by hand until it is gripped between the output rollers 34. The rollers 34 are, as mentioned above, provided with means which enable them to be moved apart to allow the web to be inserted between them.

The drive elements 26 are adjusted along the support 24 until they are properly positioned to engage the edges of the web. The motors are then switched on so that the web is advanced a short distance through the apparatus. During this movement, the engagement of the rollers 34 acts to align the longitudinal edges of the web with one another so that the fold produced is parallel to the edges. Then the support 24, together with the already located drive elements 26 is moved transversely so as to adjust the transverse position of the fold relative to the web. Once the support 24 has been located in the correct position, the apparatus will continue to form a straight fold at the chosen distance from the edges. The location of the fold across the web may be chosen at will, the only constraint limiting the range of possible positions is the ratio of the width of the web to the distance between the side pillars 18, which determines the range of movement of the support 24.

The paper feed arrangement 10 may also conveniently be provided with means for stripping the perforated edge portions (commonly found on computer stationery) from the web prior to folding.

The apparatus described may, thus, be used to form a fold in un-perforated, un-scored single or multi-sheet webs at any of a range of transverse positions on the web.

We claim:

1. Apparatus for forming a longitudinally-extending fold in a web of paper, the apparatus comprising:

a paper feed arrangement for driving the web through said apparatus, the said paper feed arrangement including a support extending transversely of the web and mounting a pair of drive members engageable with opposite longitudinal edges of the web; and paper folding means disposed below, and downstream of, said paper feed arrangement, the paper folding means including a pair of fold-plates defining a narrow gap through which the web passes to form a fold and a pair of output rollers resiliently biased into engagement with one another, between which the web passes on leaving said fold-plates, the gap defined by the fold-plates and by the output rollers extending at right angles to the support;

said support carrying said drive members being movable in a transverse direction to alter the position of the web relative to the fold-plate and, hence, to alter the transverse position of the fold formed in the web.

2. The invention set forth in claim 1, further including guide means extending between said paper feed arrangement and said paper folding means for guiding the web into the fold-plates.

3. The invention set forth in claim 2, wherein said guide means includes a member defining a V-shape having edges extending from positions spaced apart by a distance greater than the width of the web and immediately below the paper feed arrangement to a vertex substantially immediately above the fold-plates and disposed centrally thereof.

4. The invention set forth in claim 3, wherein said V-shape member lies in a plane inclined to the vertical, said plane and the vertical defining an angle substantially equal to half of the vertex angle of the V-shape member.

5. The invention set forth in claim 3, wherein said guide means is a V-shape member formed of tubular metal.

6. The invention set forth in claim 3, wherein said guide means is fixed so as to be mounted rigidly relative to the fold-plates and the paper feed arrangement.

7. The invention set forth in claim 3, wherein said guide means further includes a pair of closely-spaced guide bars above the fold-plates and parallel to the gap defined thereby.

8. The invention set forth in claim 1, wherein said drive members are tractor drives having rotary members which, in use, engage the margins of the web and which rotate to drive the web in the downstream direction.

9. The invention set forth in claim 8, further comprising a friction bar mounted downstream of said tractor drives, said friction bar frictionally engaging the web so as to prevent tension in the web being transmitted to the tractor drive.

10. The invention set forth in claim 8, including first and second motors, coupled to said tractor drives and to the output rollers respectively, and control means coupled to said first and second motors and operable to actuate said motors to drive the tractor drives and output rollers simultaneously.

11. The invention set forth in claim 10, wherein said control means is operable to drive the output rollers at a speed greater than the speed at which the tractor drives are driven.

12. The invention set forth in claim 10, wherein said control means includes means for sensing the length of the paper web between the output rollers and further web-processing means located downstream of the output rollers; the control means actuating the first and second motors in response to said sensing means.

13. The invention set forth in claim 12, wherein said sensing means includes photoelectric sensing means disposed between the output rollers and a further output roller located downstream thereof; the photoelectric sensing means being located so as to sense the presence of a loop of the paper web between the pair of output rollers and the further output roller.

14. The invention set forth in claim 1, wherein said support mounting the drive elements is provided with a screw-threaded portion engageable with a complementary screw-threaded member by means of which the support can be moved manually, transversely of the web.

15. Apparatus for forming a longitudinally-extending fold in a web of paper, the apparatus comprising:

a paper feed arrangement for driving the web through said apparatus;

paper folding means disposed below, and downstream of, said paper feed arrangement, the paper folding means including a pair of fold-plates defining a narrow gap through which the web passes to form a fold and a pair of output rollers resiliently biased into engagement with one another, between which the web passes on leaving said fold-plates; and guide means extending between said paper feed arrangement and said paper folding means for guiding the web into the fold-plates, said guide means including a member defining a V-shape having edges extending from position spaced apart by a distance greater than the width of the web and immediately below the paper feed arrangement, to a vertex substantially immediately above the fold-plates and disposed centrally thereof.

16. The invention set forth in claim 15, wherein said V-shape member lies in a plane inclined to the vertical, said plane and the vertical defining an angle substantially equal to half of the vertex angle of the V-shape member.

17. The invention set forth in claim 15, wherein said guide means is fixed so as to be mounted rigidly relative to the fold-plates and the paper feed arrangement.

18. The invention set forth in claim 15, wherein said guide means further includes a pair of closely-spaced guide bars above the fold-plates and parallel to the gap defined thereby.

19. Apparatus for forming a longitudinally-extending fold in a web of paper, the apparatus comprising:

a paper feed arrangement for driving the web through said apparatus, the said paper feed arrangement including a support extending transversely of the web and mounting a pair of tractor drives having rotary members which, in use, engage the margins of the web and which are rotatable to drive the web in a downstream direction;

paper folding means disposed below, and downstream of, said paper feed arrangement, the paper folding means including a pair of fold-plates defining a narrow gap through which the web passes to form a fold and a pair of output rollers resiliently biased into engagement with one another, between which the web passes on leaving said fold plates, the gap defined by the fold-plates and by the output rollers extending at right angles to the support; and first and second motors, coupled to said tractor drives and to said output rollers respectively, and control means coupled to said first and second motors and operable to actuate said motors to drive the tractor drives and output rollers simultaneously.

20. The invention set forth in claim 19, wherein said control means is operable to drive the output rollers at a speed greater than the speed at which the tractor drives are driven.

21. The invention set forth in claim 19, wherein said control means includes means for sensing the length of the paper web between the output rollers and further web processing means located downstream of the output-rollers; the control means actuating the first and second motors in response to said sensing means.

22. The invention set forth in claim 21, wherein said sensing means includes photoelectric sensing means disposed between the output rollers and a further output roller located downstream thereof; the photoelectric sensing means being located so as to sense the presence of a loop of the paper web between the pair of output rollers and the further output roller.

* * * * *